US012193585B2

(12) United States Patent
de Jonge

(10) Patent No.: US 12,193,585 B2
(45) Date of Patent: Jan. 14, 2025

(54) APPARATUS FOR RECEIVING AND STORING DELIVERED ARTICLES

(71) Applicant: Alexander John de Jonge, Brisbane (AU)

(72) Inventor: Alexander John de Jonge, Brisbane (AU)

( * ) Notice: Subject to any disclaimer, the term of this patent is extended or adjusted under 35 U.S.C. 154(b) by 66 days.

(21) Appl. No.: 17/778,301

(22) PCT Filed: Nov. 18, 2020

(86) PCT No.: PCT/AU2020/051244
§ 371 (c)(1),
(2) Date: May 19, 2022

(87) PCT Pub. No.: WO2021/097522
PCT Pub. Date: May 27, 2021

(65) Prior Publication Data

US 2023/0029102 A1 Jan. 26, 2023

(30) Foreign Application Priority Data

Nov. 19, 2019 (AU) ..... 2019904355

(51) Int. Cl.
*A47G 29/20* (2006.01)
*A47G 29/124* (2006.01)
*A47G 29/16* (2006.01)

(52) U.S. Cl.
CPC ..... *A47G 29/20* (2013.01); *A47G 29/124* (2013.01); *A47G 29/16* (2013.01)

(58) Field of Classification Search
CPC ..... A47G 29/20; A47G 29/124; A47G 29/16; A47G 29/141; B65D 21/086
(Continued)

(56) References Cited

U.S. PATENT DOCUMENTS 76,864 A * 4/1868 White ..... A47G 29/1207 232/17
244,227 A * 7/1881 Ginesi ..... A47G 29/1207 232/32
(Continued)

FOREIGN PATENT DOCUMENTS

CN 108346237 A 7/2018
DE 10346385 A1 5/2005
(Continued)

OTHER PUBLICATIONS

International Searching Authority (ISA/AU). International Search Report and Written Opinion, issued in PCT Application No. PCT/AU2020/051244 on Feb. 1, 2021. 14 pages.
(Continued)

*Primary Examiner* — William L Miller
(74) *Attorney, Agent, or Firm* — Meunier Carlin & Curfman LLC

(57) ABSTRACT

The present invention relates to a mailbox for receiving and holding articles. The mailbox comprising: a bag made from secure material and into which a said article is received placed, the bag being positionable between a stored position and an in-use position where the article is received in the bag. The mailbox further comprising securing means to secure the article in the bag; and, a housing in which the bag can be stored and from which the bag can be removed, the bag being secured against unauthorised removal.

19 Claims, 19 Drawing Sheets

(58) Field of Classification Search
USPC ..... 232/32
See application file for complete search history.

(56) References Cited

U.S. PATENT DOCUMENTS

| | | | | | |
|---|---|---|---|---|---|
| 292,069 | A * | 1/1884 | Teller | A47G 29/1207 | 232/32 |
| 336,052 | A * | 2/1886 | Jovine | A47G 29/1207 | 232/32 |
| 400,026 | A * | 3/1889 | Wlcek | A47G 29/1207 | 232/32 |
| 407,870 | A * | 7/1889 | Moore et al. | A47G 29/1207 | 232/30 |
| 572,893 | A * | 12/1896 | Hentz | A47G 29/1207 | 40/474 |
| 934,245 | A * | 9/1909 | Viezzi | A47G 29/1207 | 232/32 |
| 1,058,419 | A * | 4/1913 | Frediani | A47G 29/1207 | 232/24 |
| 1,550,597 | A * | 8/1925 | Viezzi | A47G 29/1207 | 232/32 |
| 1,703,620 | A | 2/1929 | Hamilton | | |
| 1,838,801 | A * | 12/1931 | Anderson | A47G 29/1207 | 232/32 |
| 5,624,071 | A * | 4/1997 | Sosan | A47G 29/20 | 232/29 |
| 6,426,699 | B1 | 7/2002 | Porter | | |
| 6,662,997 | B1 * | 12/2003 | Smith | A47G 29/1216 | 232/29 |
| 7,419,087 | B2 * | 9/2008 | Owen | B65F 1/1415 | 232/44 |
| 10,076,204 | B1 | 9/2018 | Sadeghi | | |
| 10,131,478 | B2 | 11/2018 | Maser | | |
| 10,143,320 | B1 | 12/2018 | Batts | | |
| 10,321,780 | B1 * | 6/2019 | James | A47G 29/141 | |
| 11,406,212 | B2 * | 8/2022 | Odeh | A47G 29/141 | |
| 11,412,876 | B1 * | 8/2022 | Kadlub | A47G 29/20 | |
| 2013/0077896 | A1 | 3/2013 | Wiley et al. | | |
| 2018/0202199 | A1 | 7/2018 | Critz | | |
| 2021/0045563 | A1 * | 2/2021 | Bartley-Clark | A47G 29/141 | |
| 2021/0282581 | A1 * | 9/2021 | Odeh | A47G 29/141 | |
| 2022/0395124 | A1 * | 12/2022 | Meddah | G08B 3/10 | |

FOREIGN PATENT DOCUMENTS

| | | | |
|---|---|---|---|
| DE | 202009008600 | U1 | 8/2009 |
| EP | 1161909 | A2 | 12/2001 |
| EP | 2962605 | A1 | 1/2016 |
| GB | 2560048 | A | 8/2018 |

OTHER PUBLICATIONS

EPO Extended Search Report Dated Oct. 23, 2023.

* cited by examiner

APPARATUS FOR RECEIVING AND STORING DELIVERED ARTICLES

CROSS-REFERENCE TO RELATED APPLICATIONS

This application is a national stage application filed under 35 U.S.C. § 371 of PCT/AU2020/051244 filed Nov. 18, 2020, which claims priority to and benefit of Australian patent application serial number 2019904355 filed Nov. 19, 2019, which is fully incorporated by reference and made a part hereof.

FIELD OF THE INVENTION

The present invention is directed to an apparatus for receiving and securely holding delivered articles which will typically be for use in a dwelling such as a house, flat, apartment or similar, and which contains a bag which is made of a secure material and in which a delivered article can be placed. The bag can be stored in a rolled up or otherwise compressed configuration, and, when required, can be pulled out of a housing or similar, and a parcel or other delivered article can be placed into the bag. The bag can then be locked or otherwise secured by the person delivering the article and the article can be securely and safely held in the bag until the occupant arrives home. The occupant can unlock the bag and remove the article. This allows articles to be delivered to an unoccupied premise in a secure manner. The present invention may also allow multiple deliveries to be made with each delivery able to be held safe.

The apparatus may be used for the delivery of parcels, but it is envisaged that the apparatus can also be used for deliveries from service provides such as laundry deliveries, delivery of groceries and the like.

BACKGROUND ART

Parcel deliveries to homes is becoming ever more popular. However, it is not uncommon for there to be nobody at home when the parcel is delivered. If the person delivering the parcel is unable to push the parcel through the letterbox slot because of its size or is unable to find a secure place for the parcel, the person places a slip in the mailbox and returns the parcel to the nearest post office. The occupant needs to take the slip to the post office together with identification documents in order to retrieve the parcel. This can be time consuming.

Other deliveries such as laundry or groceries may be simply placed by the front door if the premise is unoccupied. This is not secure.

It is known to provide larger personal mail boxes with a lockable area in which the parcel can be placed. As the parcel delivery person does not normally carry a key for the mail box, the box needs to have some sort of combination lock, the combination being given to the delivery person. Alternatively, the lockable area can have an open padlock, or self-locking arrangement, which is locked by the delivery person when the parcel is placed in the lockable area. A disadvantage with this arrangement is that the lockable area needs to be quite large to accommodate parcels of all sizes. This makes it unsuitable for placement on a door or in confined areas.

It is known to provide a parcel receiving box which is hung over the front of a door. A hook extends over the door such that when the door is closed, the box is held in place on the door. The box needs to be large to accommodate large parcels. The box has an upper part which is fixed and which has a door or flap through which parcels can be passed. The box has a larger lower part in which the parcel is ultimately stored until the owner returns. The lower part is made from rigid hinged panels which can be folded such that the panels overlie each other. In this configuration, the lower part of the box is "collapsed" and does not project as much from the front of the door. Dropping a parcel through the rigid upper part and into the lower part can cause the lower part to "expand" into a box like configuration due to the weight of the parcel. The delivery person is also able to pull the lower part outwardly into the expanded position if the weight of the parcel is insufficient to do so.

It is known to provide parcel security boxes or containers made of metal or other secure material and which is chained or otherwise securely attached next to a front door. The box can be locked once a parcel has been placed into the box.

It is known to provide a large strong lockable box on a front door in which a parcel can be placed. The box is not collapsible. Inside the box is a sack for larger items. For such large items, the box can be opened and the sack removed. A large item can be placed in the sack and the sack is attached to a security hook which is accessible only by unlocking the lockable box. This arrangement is quite complicated.

Another disadvantage with parcel security devices is that is that if first parcel is delivered and locked into the lockable area, a second parcel delivery usually cannot be made, or cannot be made without making the first parcel accessible. Many homes or businesses can receive more than one parcel per day and at different times and by different delivery organisations.

Other disadvantages with the above devices for storing parcels is the large size and weight of the device, the relatively high cost of manufacture of such large and complex devices, the relative large projection of the device from a door (allowing for a possible striking hazard), the complicated method of use of the device, and the like.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide an apparatus for receiving and storing parcels which can at least partially overcome some of the above-mentioned disadvantages or provide a useful or commercial choice in the marketplace.

In one form, the invention comprises an apparatus for receiving and holding articles, the apparatus comprising a bag made from secure material and into which a said article can be placed, the bag being positionable between a stored position and a use position where the article can be placed in the bag, securing means to secure the article in the bag, and a housing in which the bag can be stored and from which the bag can be removed, the bag being secured against unauthorised removal.

An advantage of a bag is that the bag can be made quite large to accommodate articles of various sizes. When not required, the bag can be rolled up, folded, crumpled, knocked down, crushed or otherwise compressed and stored.

The articles may comprise delivered parcels/packages.

The bag can be made of any suitable secure material. One suitable secure material may comprise a metal mesh. A stainless-steel knitted cable mesh may comprise a suitable metal mesh. Another suitable material may comprise small metal rings linked together in a pattern to form a mesh. Such a material is sometimes called chainmail. Another type of secure material may comprise a slash proof fabric which typically comprises some form of flexible metal mesh within the fabric. Other types of secured material may comprise laminated flexible materials, woven or non-woven materials, strong canvas material, Kevlar or similar types of materials and the like. The bag may contain a first area of one suitable secure material and a second area of a second suitable secure material. The bag may comprise opaque material such that the contents of the bag cannot be easily viewed. The bag may comprise water repellent, water resistant, or waterproof material. The bag may comprise insulating material. The bag may comprise cushioning material. The bag may comprise zones adapted to accommodate heating or cooling bags, ice bricks and the like. The bag may comprise reflective material.

The bag may comprise flexible inextensible material. Alternatively, the bag may comprise stretchable material. it is also envisaged that the bag may comprise a combination of flexible inextensible material and stretchable material. It is also envisaged that the bag may have portions which are semi-rigid or rigid and portions that are flexible as long as the bag as a whole is relatively flexible and is able to be rolled up, folded, crushed, or otherwise compressed into a smaller storage size.

The shape and size of the bag may vary. It is envisaged that the shape and size of the bag will be such that when in use, the bag is able to accommodate parcels up to a size that are usually delivered to a dwelling. Thus, it is considered that the shape and size of the bag should be such that it can accommodate a parcel of at least a shoe box size, but it is considered that no particular limitation should be placed on the shape and size of the bag merely by exemplification of certain parcel sizes.

In a preferred embodiment, it is envisaged that the bag will have a volume of approximately 20-50 l, thereby enabling it to accommodate a large range of parcel sizes.

The bag may have a relatively circular or oval cross-section. Alternatively, the bag may be substantially rectangular in cross-section. Other shapes are also envisaged.

The bag may comprise one or more compartments or areas that can be separately secured. This can enable the bag to accommodate more than one parcel at more than one time without any parcel becoming accessible to unauthorised persons. Thus, a first parcel delivery person may be able to place a parcel in one compartment and secure that compartment. A second parcel delivery person may then be able to place a second parcel in a second compartment in the bag without having any access to the first parcel.

The bag will suitably contain between 1-3 compartments or areas each of which is able to be separately secured.

If separate compartments/areas/zones are provided, these may comprise different materials. Thus, one compartment may comprise cushioning material and another compartment may comprise insulating material.

The bag is typically positionable between a stored position and a use position where the parcel can be placed in the bag. In the stored position, the bag is typically rolled up, folded, crushed, or otherwise compressed into a smaller volume. In the use position, the bag is typically unrolled, unfolded, and the like to enable the internal volume of the bag to be used.

An advantage of this arrangement is that the apparatus can be made relatively compact while still enabling relatively large parcels to be securely stored by the apparatus by virtue of being able to remove the stored bag, placing the parcel in the bag and securing the parcel in the bag.

The apparatus typically comprises some form of housing in which the, or part of the bag can be stored or held. The housing may comprise a container. The container may comprise a metal container having a compartment in which the bag can be stored and from which the bag can be at least partially removed to enable a parcel to be placed in the bag. The compartment may have a door or other form of access to enable the bag to be at least partially removed from the compartment. The compartment may have a lid that can be unscrewed or hinged open or pulled off to enable access to the bag. The compartment may have an opening from which the bag can be removed.

The housing may only partially house the bag. Thus, the housing may comprise some form of top cover underneath which the bag can be stored. In this alternative, the housing need not entirely enclose the bag. The bag may be attached to the housing by straps or bands or similar. The straps may comprise Velcro straps to enable the bag to be removed from the stored position and placed in the use position by opening the Velcro straps. Alternatively, elastic bands may be used to hold the bag in the stored position. Other types of fastenings are envisaged including spring clips, press studs, and the like. However, it is also envisaged that the housing will substantially encompass the bag such that the bag can be simply placed into the housing and pulled from the housing to adopt the use position.

The bag is secured against unauthorised removal. In one form, the bag will be securely attached to the housing when in the stored position and the use position to prevent the bag from being removed. In this form of the invention, the housing can be securely fastened to a support such as a door, or a wall, or to a post or to any other type of support to prevent the housing from being removed. The bag can be attached to the housing by any suitable means including the use of fasteners, adhesives, stitching, welding, or any other suitable means. it is also envisaged that the bag may be attached to an intermediate member such as a chain or metal wire or similar with the intermediate member being securely fastened to the housing or to an adjacent support. In this alternative, the housing need not be securely fastened to a support as the bag is securely fastened against unauthorised removal by virtue of the intermediate member.

It is envisaged that the housing may be fastened to the rear of an entry door in which case it may not be necessary to manufacture the housing from strong tamper proof material. In this form of the invention, the door may contain a slot or similar opening through which the bag can be accessed to enable the bag to be moved to its use position. A parcel can then be placed in the bag and secured and the bag will hang from the front of the door with the parcel in the bag.

Securing means is provided to secure the parcel in the bag. In one form, the bag will have an opening through which a said parcel can be placed. The opening can then be locked by any suitable means. In one form, a drawstring is placed adjacent the opening to close the opening, and the drawstring can be locked against being undone by a padlock or similar. Alternatively, the bag may be provided with a series of small openings, eyelets, loops and the like which can be drawn together and the shank or shackle of a padlock can be passed through two or more of the openings to close the bag sufficiently to prevent the parcel from being removed. In a further alternative, the apparatus may be provided with a chain lock or similar and the parcel delivery person can use the chain lock to close off the bag once the parcel is placed in the bag.

If the bag is provided with multiple compartments/zones to enable multiple parcels to be secured separately in the bag, it is envisaged that the opening of each of the multiple compartments will have a securing means which may be of the type described above to secure the parcel in the bag against unauthorised removal.

The apparatus may be associated with a conventional letterbox such that the apparatus can replace a conventional letterbox. It is envisaged that the apparatus may have a first compartment containing a letterbox slot through which letters can be placed in the usual manner by a postman. The apparatus may further contain the flexible bag and some form of housing in which the bag can be stored and from which the bag can be removed to adopt the use position.

In a particularly preferred embodiment, it is envisaged that the apparatus will comprise a combined conventional type letterbox and parcel accepting bag of the type described above and below with the entire apparatus being of relatively compact size and therefore able to be attached to a door (either the front of the door or the back of the door) or on a wall next to the door, and typically in the case of a house, next to the driveway. In a particularly preferred embodiment, it is envisaged that the apparatus can replace a conventional letterbox and can be achieved in a DIY manner.

In another form the invention may comprise an apparatus for receiving and holding parcels, the apparatus comprising an at least partially foldable container made of secure material and into which a said parcel can be placed, the container being positionable between a stored position and a use position where the parcel can be placed in the container, securing means to secure the parcel in the container, the container being secured against unauthorised removal.

The at least partially foldable container may comprise foldable rigid or semi-rigid panels. These panels may be made of secure material such as strong plastic, metal, reinforced materials, laminated materials and the like. The panels may be hinged to each via integral hinges, separate hinges and the like. It is envisaged that the foldable container may be able to fold into a substantially flat configuration when in the stored position and can then be removed and opened into the use position. The at least partially foldable container may comprise a lockable lid which can be locked by the parcel delivery person to secure the parcel in the container. The at least partially foldable container may comprise more than one lockable compartment to allow more than one parcel to be placed in and securely locked into the container. The at least partially foldable container is secured against unauthorised removal. In one form, the container may be attached to part of the apparatus by a chain, a steel wire, or other secure attachment means which prevents unauthorised removal of the container but still enables the container to be opened up into the use position. It is also envisaged that the container may be secured to a support adjacent the apparatus by a chain, a steel wire, or other secure attachment means.

The at least partially foldable container may comprise a flexible bag. If the at least partially foldable container comprises a flexible bag, a housing may be provided in which the bag can be stored and from which the bag can be removed.

In another aspect of the present invention, there is provided a mailbox for receiving and holding at least one article, the apparatus comprising:

a container for receiving the at least one article, the container positionable between a stored position and an in-use position defining a volume larger than the volume of the container when in the stored position, and being secured against unauthorised removal;

a housing for at least partially housing the container and from which the container can be at least partially removed, the housing including a base having a slot for passing at least a portion of the container therethrough; and, at least one securing means for securing the at least one article in the container;

wherein the container and the at least one securing means are configurable to define one or more compartments when the container is in the in-use position, each compartment adapted to receive an article of the at least one articles and adapted to be secured against unauthorised removal of the article.

The container may be rollable, foldable, crushable, or otherwise compressible into a smaller volume for storing.

The housing may include a base. The base may include an opening through which at least a portion of the container extends when in the in-use position. The opening may be in the form of an elongate slot.

The housing may define an internal volume, and further comprise an internal shelf for dividing the internal volume into an upper volume for housing letters and a lower volume for housing the container.

The housing may include a door for accessing the upper volume and the lower volume, and wherein the door forms a front panel of the housing. In alternative embodiment, the housing may include a door for accessing the lower volume, and a door for accessing the lower volume. The door may be in the form of a hinged door or panel.

The door may include a letterbox slot for receiving letters into the upper volume of the internal volume. The letterbox slot may include a hinged panel for preventing ingress of dirt or the alike from entering the letter box slot. The door may further include a securing mechanism. The securing mechanism may be in the form of a lock, cam lock, quarter turn lock, or the alike. The securing mechanism may be configurable in a locked configuration and an unlocked configuration. The door may further include at least one tab for aiding opening of the door when the door is in the unlocked configuration. The at least one tab may be in the form of a side tab.

The housing may include at least one opening in the base for allowing liquids to drain out of the housing.

The mailbox may further include at least one container securing member for securing the container to the housing. The at least one container securing member may be in the form of a hook, D-bracket, or the alike. Each securing member may be positioned within the lower internal volume of the housing.

BRIEF DESCRIPTION OF THE DRAWINGS

Embodiments of the invention will be described with reference to the following drawings in which:

FIG. 33*a*, in particular, shows a cross section of a preferred sack or bag.

DETAILED DESCRIPTION OF PREFERRED EMBODIMENTS

Figure 1:
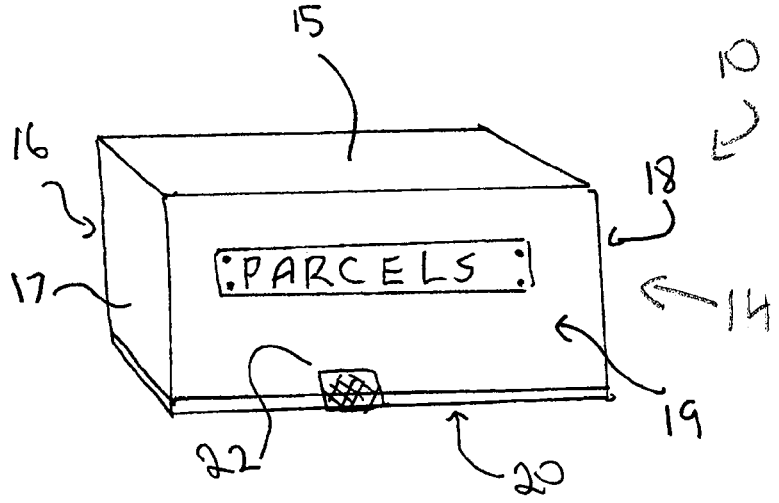
FIG. 1 illustrates an apparatus able to receive parcels and in the non-use position.
Figure 2:
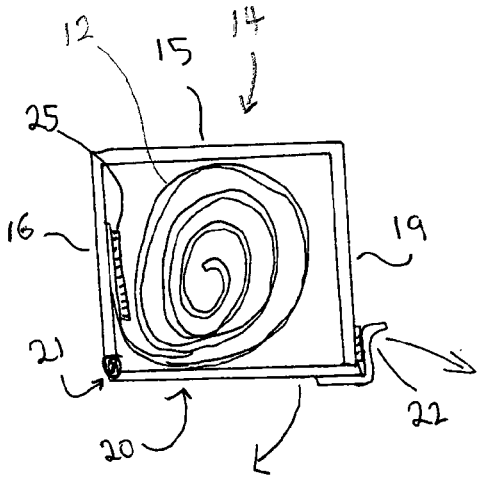
FIG. 2 illustrates the apparatus of FIG. 1 in side view and illustrating the internal bag.
Figure 3:
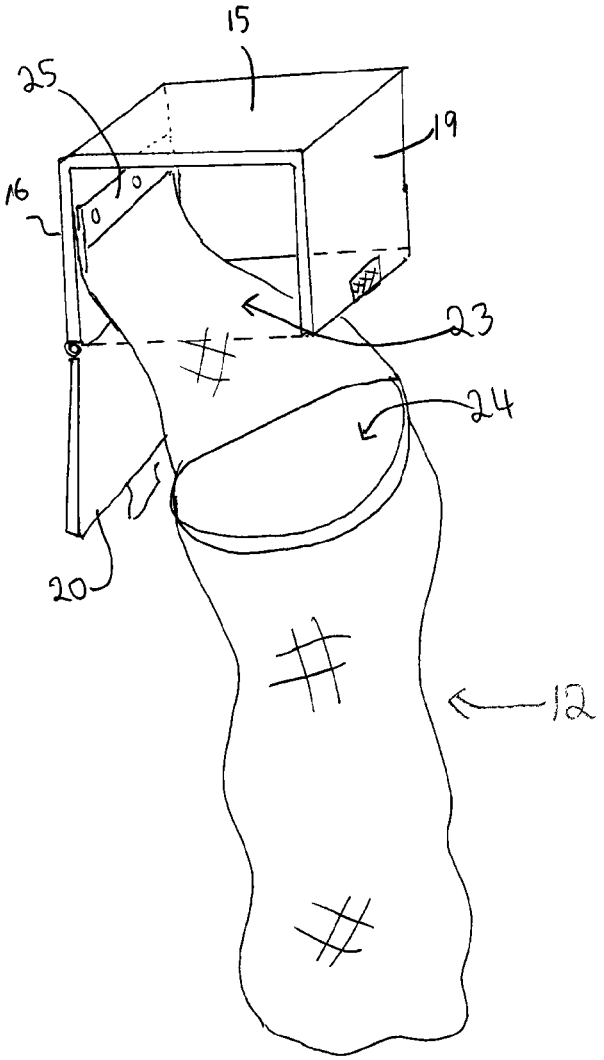
FIG. 3 illustrates the apparatus of FIG. 1 where the internal bag has been dropped down and is able to receive a parcel.

Referring initially to FIGS. 1-3, there is illustrated an apparatus adapted to receive articles which in the preferred embodiments will be referred to as parcels/packages but it should be appreciated that the apparatus can be used to receive items other than parcels. The apparatus comprises an external housing 14 in which is located a removable flexible bag 12.

The housing 14 as illustrated in this particular embodiment is substantially rigid and rectangular when viewed in plan and side elevation. It is envisaged that the housing 14 will be manufactured from metal, rigid plastic or similar materials and will be relatively weatherproof.

Housing 14, in the particular embodiment, comprises a top wall 15, a rear wall 16, opposed sidewalls 17, 18, a front wall 19 and a bottom wall 20 which is in the form of a hinged door. The size and shape of housing can vary but an advantage of the present invention is that the apparatus can be made relatively compact while still enabling relatively large parcels to be delivered and securely stored by the apparatus. Therefore, in a particular non-limiting embodiment, it is envisaged that the apparatus will have a length of between 20-40 cm, a height of between 10-20 cm, and a width of between 10-20 cm. It should however be appreciated that no unnecessary limitation should be placed on the invention merely by describing certain dimensions of the apparatus.

Figure 3A:
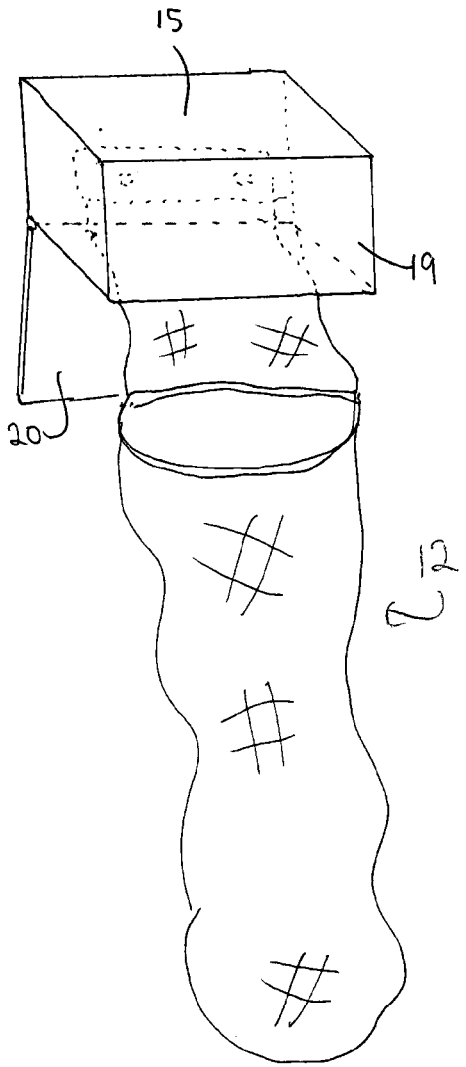
FIG. 3A illustrates the apparatus of FIG. 3 from a front view.

Door 20 is hinged by hinge 21 to rear wall 16 and this enables door 22 move from a closed position illustrated in FIG. 2 to a drop-down open position illustrated in FIG. 3 and FIG. 3A. Door 20 is held in the closed position illustrated in FIG. 2 by any suitable type of catch member or similar. FIG. 2 illustrates a pull tab 22 having one end secured to door 20 and the other end attached to part of front wall 19. In the particular embodiment, it is envisaged that pull-tab 22 comprises a Velcro material. Thus, a parcel delivery person can pull pull tab 22 to release door 20 and the positioning of the door 20 on the bottom of the apparatus will cause the door to drop down into the open position illustrated in FIGS. 3 and 3A by gravity. Inside housing 14 is a flexible bag 12. Bag 12 in the particular embodiment is shown as being rolled up inside housing 14 but it is envisaged that the bag (depending on its manufacture) may be simply pushed into the housing, or folded into the housing and the like. However, in this particular embodiment, the bag will be described as being rolled up inside housing 14.

When door 20 is dropped down into the open position, this will cause bag 12 to fall out of the bottom of the housing and naturally unroll into the open use position illustrated in FIG. 3 and FIG. 3A. That is, no further manipulation of the bag is required.

Figure 25:
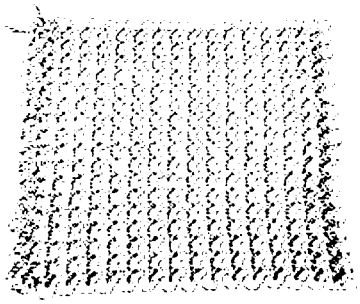
FIG 25 (PRIOR ART)
FIG. 25 illustrates examples of PRIOR ART stainless steel knitted mesh which can be used to manufacture the bag of the present invention.
Figure 26:
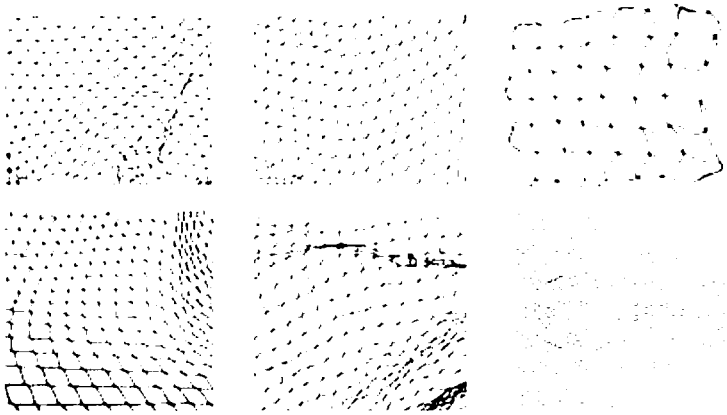
FIG 26 (PRIOR ART)
FIG. 26 illustrates a PRIOR ART chain mesh from which the bag can be made.

Bag 12 is manufactured from secure material. Various types of materials are envisaged but in the particular embodiment, bag 12 will be manufactured from a stainless-steel knitted cable mesh. An example of such a mesh is illustrated in FIG. 25. In this particular embodiment, bag 12 may comprise only the cable mesh, or may comprise a fabric in which the cable mesh is embedded. Of course, other types of materials that are secure and therefore not able to be easily cut or slashed are envisaged.

Bag 12, in the particular embodiment, has a substantially circular or oval cross section, a length of between 50-100 cm and a diameter or cross-section of between 20-50 cm. Of course, no unnecessary limitation should be placed on the invention merely by the exemplification of certain bag sizes.

Figure 23:
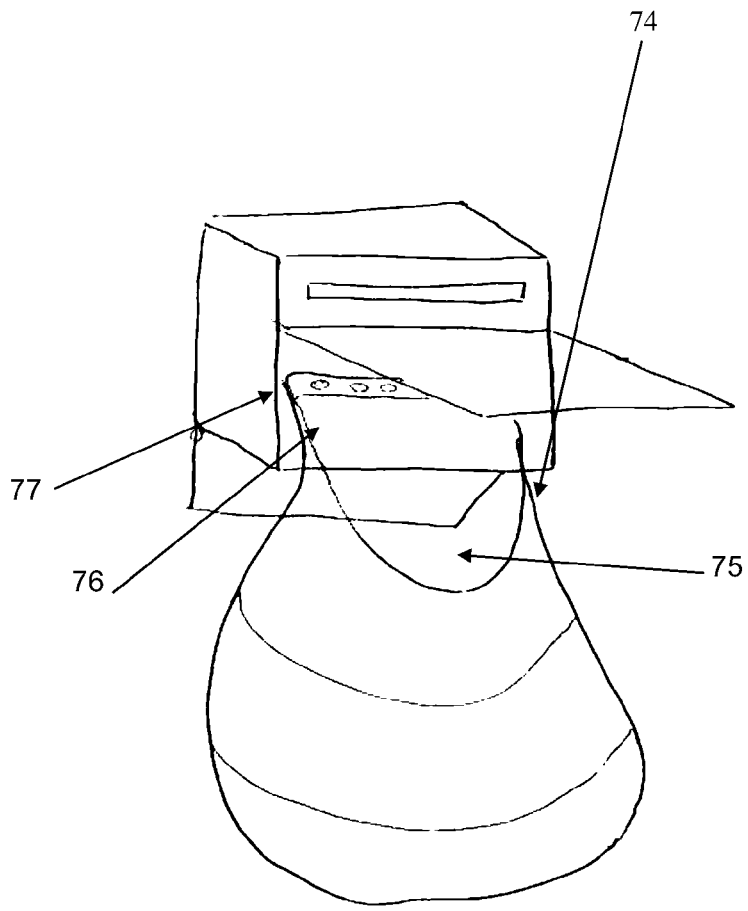
FIG. 23 illustrates an embodiment of the invention wherein the bag has a large mouth area, a portion of which can be used to secure the bag to the housing such that a panel portion is not required.
Figure 24:
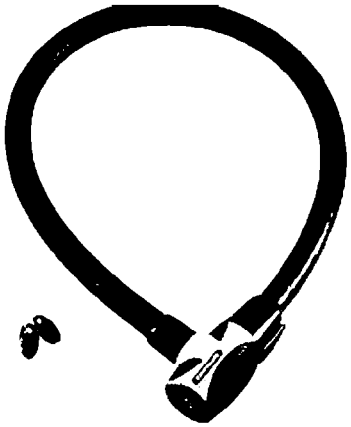
FIG 24 (PRIOR ART)
FIG. 24 illustrates an example of a PRIOR ART cable lock illustrated in FIG. 17A.

In the particular embodiment, bag 12 contains a portion 23 which is illustrated at least in FIG. 3 and which allows the open mouth 24 of bag 12 to be positioned away from housing 14. Portion 23 may comprise a panel portion. It is found, however, that panel portion 23 can be omitted in respect of bags having a very wide mouth 24 in which case part of the mouth can be secured inside the housing with the remainder of the mouth still being accessible for parcels. An example of a wide mouth bag is illustrated in FIG. 23.

Panel portion 23 is manufactured from secure material and has an end portion which is fastened securely to part of the housing 14. In this particular embodiment, the end portion is secured to the rear wall 16 by any suitable means which may comprise being sandwiched between rear wall 16 and a steel strip 25 (see FIG. 3) steel strip 25 being riveted, welded, or otherwise fastened to rear wall 16.

Figure 4:
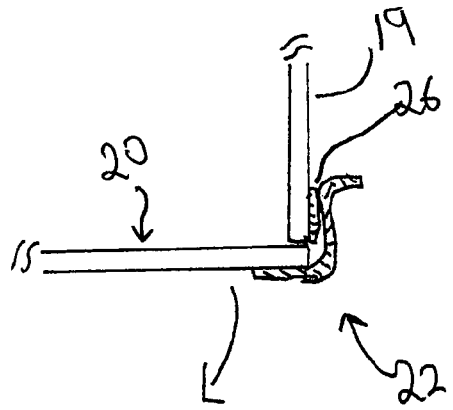
FIG. 4 illustrates an embodiment of the apparatus and particularly illustrates a first mechanism to hold the bottom door in the closed position.

FIG. 4 illustrates the option of the pull tab 22 in greater detail, and illustrate a Velcro patch 26 on the front wall 19 to which the pull tab 22 is fastened. This allows easy opening of door 20.

Figure 5:
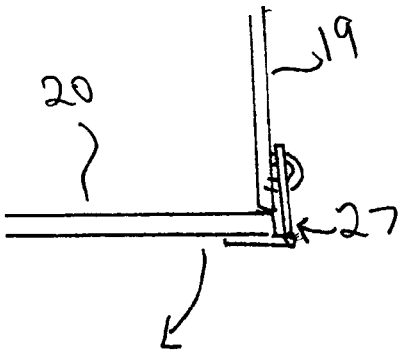
FIG. 5 illustrates another embodiment of the apparatus and illustrates a second mechanism to hold the bottom door in the closed position.

FIG. 5 illustrates another option by which bottom door 20 can be open and closed. In this option, a clasp 27 is provided to enable the door to be open and closed. Clasp 27 enables a padlock (not illustrated) to be used to lock bottom door 20 should there be any desirability in doing this. It should also be appreciated that various other closure mechanisms can be used to secure bottom door 20.

Figure 6:
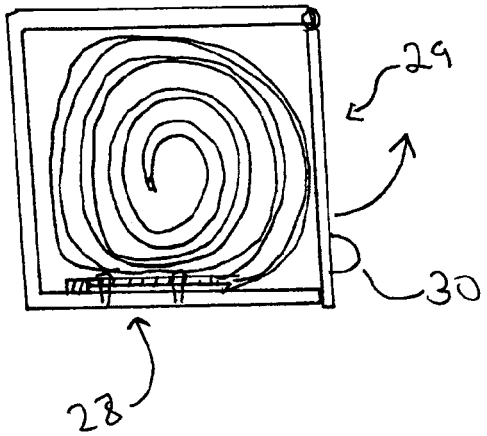
FIG. 6 illustrates an embodiment of the invention where the apparatus has a front opening door instead of a bottom opening door.
Figure 7:
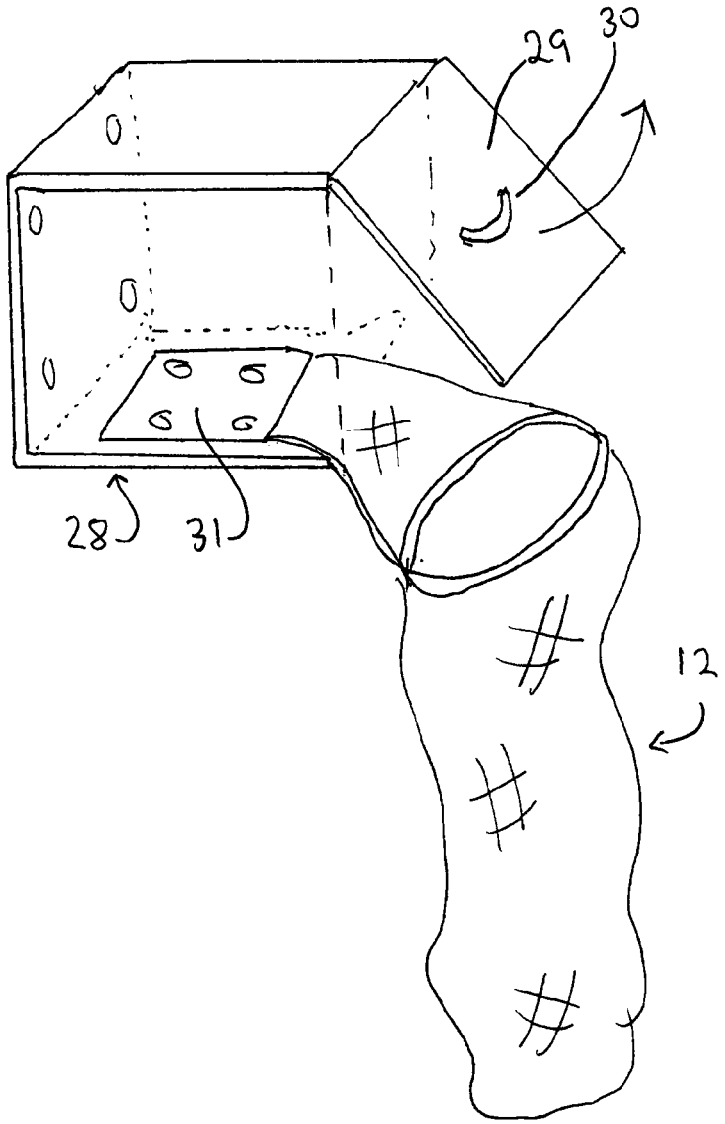
FIG. 7 illustrates the embodiment of FIG. 6 where the bag has been removed and is in the use position.

Referring now to FIG. 6 and FIG. 7, there is illustrated a further embodiment of the invention which is substantially similar to the embodiment described above except that the housing contains a fixed bottom wall 28 and a front opening door 29. A door handle 30 may be provided to make it easier to open the door from the position illustrated in FIG. 6 to the position illustrated in FIG. 7. When door 29 is lifted into the open position, the internal bag 12 can be unrolled and dropped down to the use position illustrated in FIG. 7. The bag 12 is fastened to the bottom wall 28 of the housing by being sandwiched between bottom wall 28 and a steel plate 31 which can be riveted or otherwise fastened to bottom wall 28 to secure the bag in place. An advantage of the apparatus according to this embodiment, is that it may be slightly easier to repack the bag back into the container. Again, the bag need not be rolled up and can be simply folded or crushed and pushed into the container.

Figure 8:
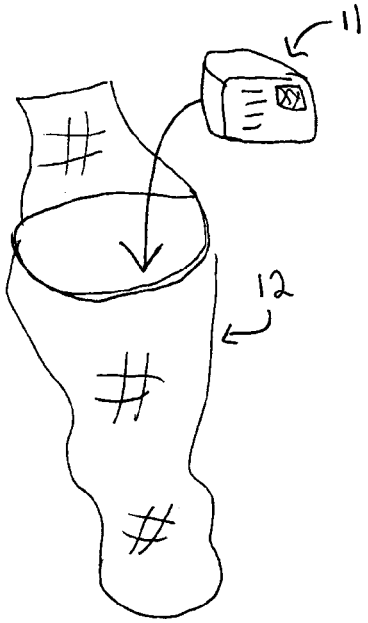
FIG. 8 illustrates an embodiment of the invention where a parcel can be placed through the open mouth of the bag.
Figure 9:
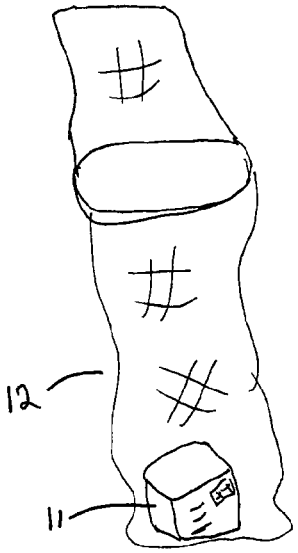
FIG. 9 illustrates the embodiment of FIG. 8 where the parcel has been dropped to the bottom of the bag.
Figure 10:
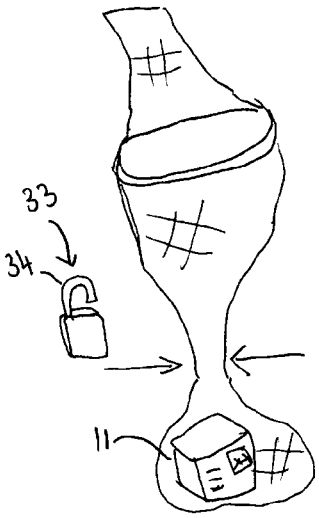
FIG. 10. illustrates the embodiment of FIGS. 8 and 9 where the bag portion immediately above the parcel has been necked.

Referring now to FIGS. 8-11, there is illustrated sequentially how a parcel can be inserted into the bag and secured. Referring initially to FIG. 8, a parcel 11 can be placed into the open mouth of bag 12 it being appreciated that bag 12 has been unrolled or unpacked into the use position examples being illustrated in FIG. 3 and FIG. 7. Parcel 11 can then be dropped or placed to the bottom of the bag this being illustrated in FIG. 9. The area of the bag immediately above parcel 11 can then be necked as Illustrated in FIG. 10 and a padlock 33 can be placed such that the shackle 34 (see FIG. 11) extends about the necked portion. The padlock can then be locked such that parcel 11 is locked into and securely held in the bottom of bag 12 this being again illustrated in FIG. 11.

Figure 11:
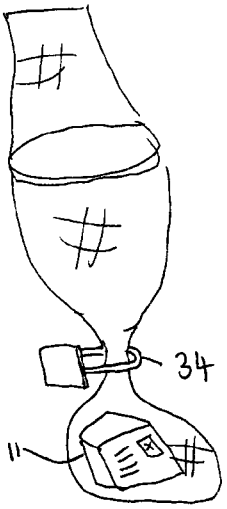
FIG. 11 illustrates the embodiment of FIG. 10 where a padlock has been locked around the neck portion to lock the parcel into the bag.
Figure 12:
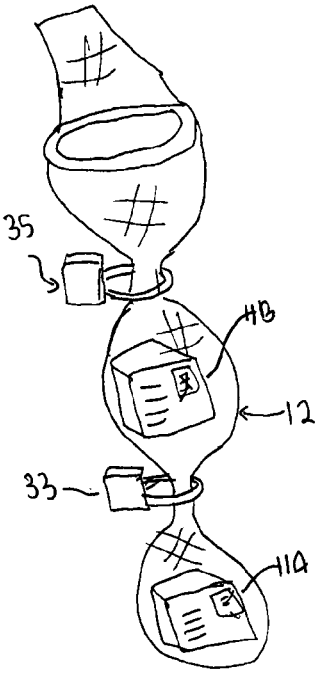
FIG. 12 illustrates a bag containing two separate parcels each of which is locked and by a padlock.

An advantage of an embodiment of the present invention will now be described and is illustrated with reference to FIG. 12. FIG. 12 illustrates how a number of parcels 11A, 11B can be separately held in bag 12 with the parcels unable to be accessed by anybody other than the owner. That is, when a parcel is locked in the bottom of bag 12 as illustrated in FIG. 11, should a second parcel delivery be made, the second parcel 11B can be placed above padlock 33 and a second padlock 35 can be used to lock second parcel 11B in the bag. The delivery person delivering the second parcel 11B is not able to access the first parcel 11A which has already been locked in the bag by padlock 33.

Figure 13:
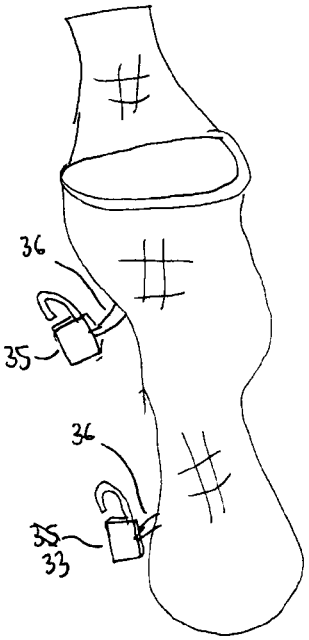
FIG. 13 illustrates a bag containing two padlocks which are attached to the bag such that the padlocks cannot be inadvertently misplaced.

In one embodiment of the invention, the padlocks 33, 35 (it being appreciated that there may be more than two padlocks), may be simply placed within housing 14 and the parcel delivery person can then use one of the padlocks to lock the parcel in bag 12. However, because these padlocks are loose, there may be situations where the padlocks may become inadvertently lost. Therefore, and referring to FIG. 13, there is illustrated an embodiment of the invention where padlocks 33, 35 are secured to some form of retaining member 36 which may be in the form of a strap, a steel wire, a small chain and the like.

Figure 14:
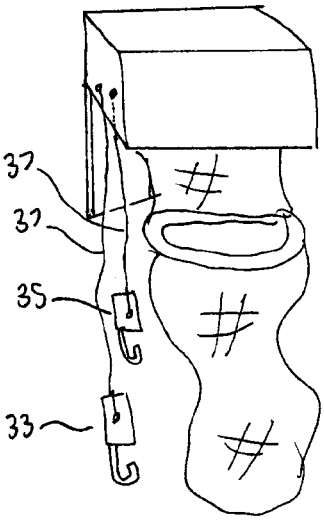
FIG. 14 illustrates an embodiment of the invention where the padlocks are attached to secure line members such that the padlocks cannot be inadvertently misplaced.

In another embodiment of the invention, and as illustrated in FIG. 14, the padlocks 33, 35 may be attached to secure line members 37 which may comprise wire rope, chain and the like with the secure line members 37 being attached to an internal part of housing 14. Opening the door of housing 14 can cause the locks to drop out if the door is a bottom opening door as illustrated in FIG. 14 or, if the door is a front opening door, the locks can be simply removed by the parcel delivery person but cannot be misplaced as the locks are attached to the line members 37. In the embodiment illustrated in FIG. 14, the line members 37 can be of different lengths to enable various parts of the bag to be accessed.

The padlocks may be in the unlocked position with the key removed. The parcel delivery person then locks a delivered parcel in the bag. Alternatively, the padlock contains a key and the parcel delivery person locks the padlock and drops the key into a small secure compartment on the housing (not illustrated) and which contains a key slot. The key and padlock may be of the type where the key cannot be removed from the padlock until after the padlock is locked. Such locks are known.

In a further embodiment, the bag may be locked in one or more positions by one or more lockable metal cords which are looped around the bag and which can be pulled through a locking device to neck the bag and to lock the parcel in the bag. It is also envisaged that a simple linked chain and a padlock may be used to lock a parcel in the bag. It is also envisaged that some form of lockable alligator clip can be used.

Figure 15:
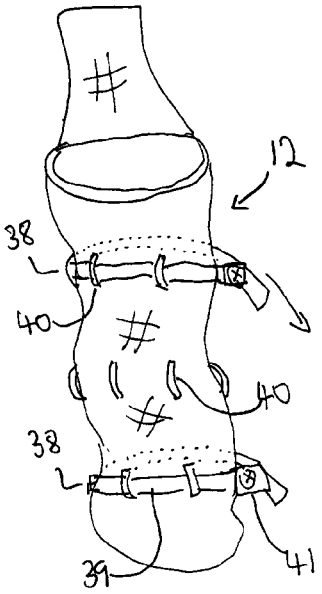
FIG. 15 illustrates an embodiment of the invention comprising lockable straps.
Figure 16:
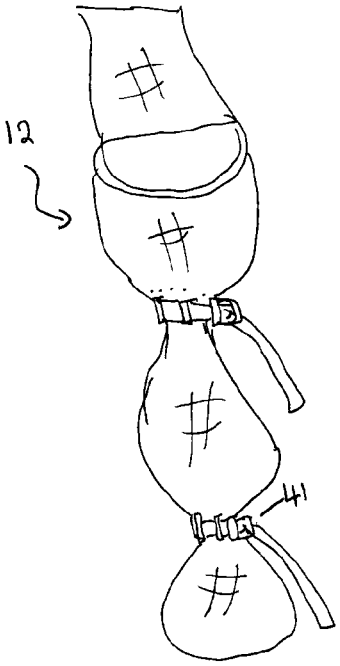
FIG. 16 illustrates the embodiment of FIG. 15 where the straps have been tightened and locked.

Referring now to FIG. 15 and FIG. 16, there is illustrated another embodiment of the invention and particularly another way of securing parcels in bag 12. In this particular embodiment padlocks are not used. Instead, lockable strap members 38 are provided. Strap members 38 comprises a strap portion 39 which extends about bag 12 and which can be held in place by eyelets 40. The strap members 38 further comprises a key lock portion 41 through which the strap portion 39 can pass and upon locking the key lock portion 41, the strap is locked. These lockable strap members are known and an example of such members can comprise lockable luggage straps.

In use, once a parcel (not illustrated) is placed in the bottom of bag 12 in FIG. 15, the lower strap member 38 can be closed to neck the bag above the parcel and to lock the parcel in the bag, this being illustrated in FIG. 16. A second parcel can then be delivered and placed above the lower locked strap member and the upper strap member can then be pulled tight to lock the second parcel in the same bag, this being illustrated in FIG. 16 (although the parcel is not illustrated). FIG. 15 also shows an intermediate set of eyelets 14 and this illustrates that the invention can allow a parcel delivery person to select the desired set of eyelets through which to attach the strap members. However, it is preferred that the strap members are secured to the bag such that they cannot be inadvertently removed and in this particular embodiment, this will require a third strap member to be positioned through the intermediate eyelets illustrated in FIG. 15

Figure 17:
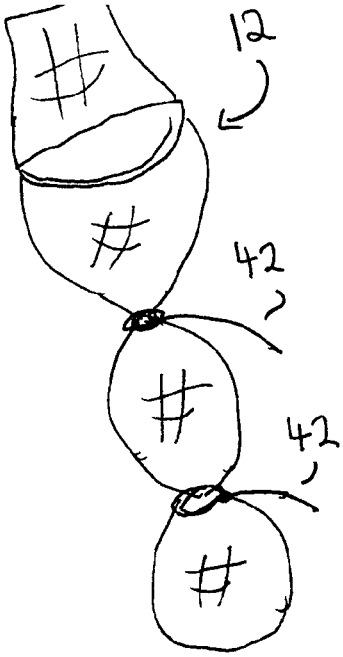
FIG. 17 illustrate an embodiment of the invention where commercially-available zip ties are used instead of lockable straps or padlocks.

Referring to FIG. 17, there is illustrated a bag 12 where portions of the bag are separated by commercially available zip ties 42. in this embodiment, separate parcels (not illustrated) cannot be said to be separately secured as it is possible to simply cut the zip ties but it is envisaged that this embodiment does provide a simple "tamper-evident" arrangement as opposed to a tamper proof arrangement which is Illustrated in the previous embodiments.

Figure 17A:
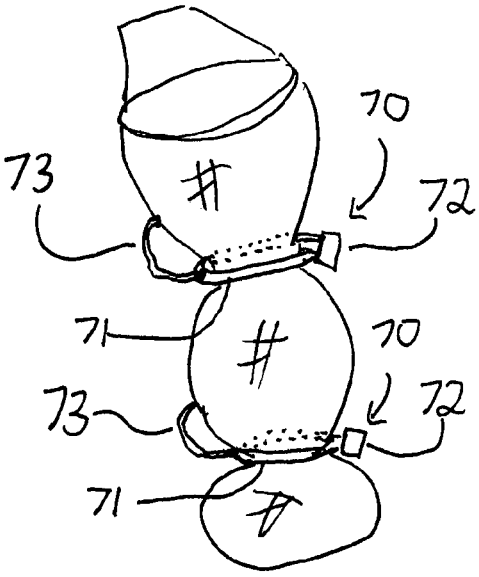
FIG. 17A illustrates an embodiment where the bag is locked by a cord lock device.

FIG. 17A illustrates another embodiment of a bag locking device 70. The device comprises a semi flexible secure cord 71 which can be push locked into a lock 72 positioned at one end. This type of lock is often used as a bicycle lock but can be used with the present invention with little modification. This device can be used instead of the locking straps of FIGS. 15-16. The device of this embodiment is not length adjustable, so the cord length can be made to cause the bag to be necked when the device is used. Device 70 can be loose and attached by the parcel delivery person. Alternatively, the device can be supported by the bag via eyelets of the type illustrated in FIGS. 15 and 16. Alternatively, the device can be attached to the bag by cut proof line members 73 that may comprise metal lines.

Figure 18:
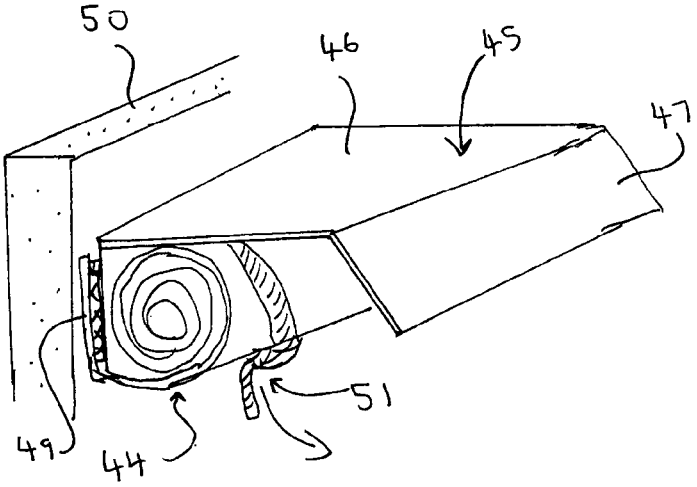
FIG. 18 illustrates an embodiment of the invention where the bag is protected by a flashing member.
Figure 19:
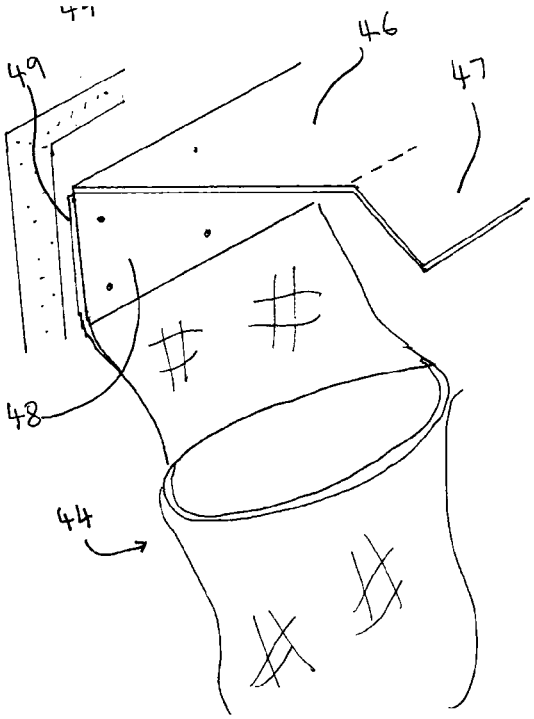
FIG. 19 illustrates the embodiment of FIG. 18 where the bag has been dropped down into the use position.

FIGS. 18 and 19 illustrate another embodiment of the invention. In this embodiment, bag 44 can be moved between a rolled-up position illustrated in FIG. 18 and a drop-down use position illustrated in FIG. 19. Bag 44, when in the position illustrated in FIG. 18, is protected by a top flashing 45 which can be made of pressed metal. Flashing 45 has a top wall 46, a small front wall 47 and a rear wall 48 which is better illustrated in FIG. 19. Bag 44 has an upper portion 4 to 9 which is secured to the back of rear wall, and when the apparatus is fixed to the support 50, the upper portion is sandwiched between the support 50 and the rear wall 48. This secures the bag against being stolen. When the bag 44 is in the rolled-up position of FIG. 18, it is held in place by a pull open strap 51. In this embodiment the housing comprises the top flashing.

Figure 20:
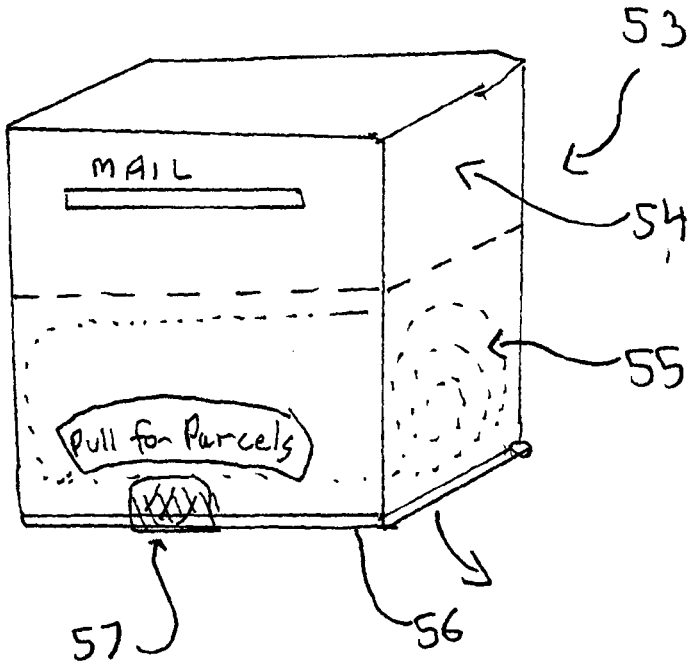
FIG. 20 illustrates an embodiment of the invention where the apparatus comprises a first compartment adapted to receive letters in the usual manner and a second compartment containing the flexible bag and which can be opened should a parcel be required to be placed in the bag.

FIG. 20 illustrates an embodiment of the invention which can replace an existing mail pox with the apparatus of the invention. This embodiment may also be suitable for new mail boxes. The apparatus 53 comprises an upper conventional type mail box 54 for letters and a lower integrated compartment 55 which houses the drop-down bag which may be as described previously with reference to above embodiments. The bottom wall of compartment comprises a drop-down door similar to that of FIG. 3 at least. A door closure 57 in the form of a pull-down Velcro tab is provided.

Figure 21:
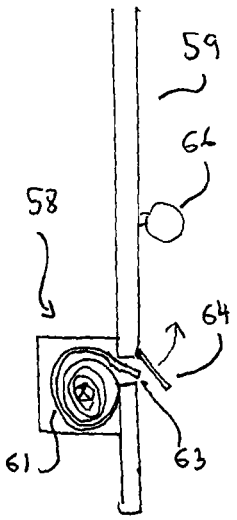
FIG. 21 illustrates an embodiment of the invention where the apparatus is mounted to the rear of a door and the bag can be accessed through a slot in the door.
Figure 22:
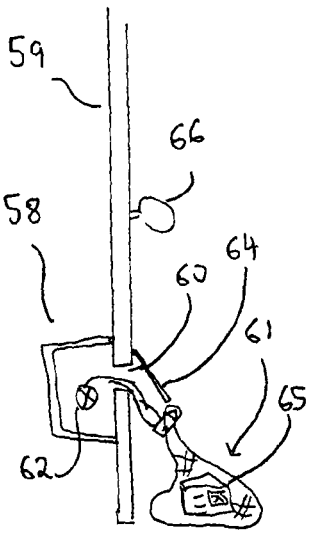
FIG. 22 illustrates the embodiment of FIG. 21 where the bag has been pulled through the slot in the door and a parcel has been placed in the bag.

FIGS. 21 and 22 illustrate another embodiment of the invention. In this embodiment, the apparatus comprises a housing 58 which is located behind a door 59 which may be a front door. Door 59 contains a slot 60 through which a bag 61 can pass. Bag 61 is initially in a rolled-up non-use position illustrated in FIG. 21 and, in this particular embodiment, is wound about an axle 62. Axle 62 is rotatable about its longitudinal axis and is journaled or otherwise supported for rotational movement by housing 58. The front of bag 61 may have a small pull tab 63 which is accessible by a parcel delivery person through slot 60 when the bag is in the rolled-up position Illustrated in FIG. 21. Slot 60 can be covered by a hinged flap 64. In use, a parcel delivery person comes to the front door, lifts up flap 64 and pulls on tab 63 to pull out bag 61 to the front of the door. A parcel 65 can then be placed and locked in the bag in a manner described in one or more of the above embodiments. Bag 61 is securely attached to axle 62 such that the bag cannot be completely removed from housing 58 and stolen. When the home occupant returns, the occupant can remove the parcel and can rewind bag 61 to the retracted rolled up position illustrated in FIG. 21. A small turn knob or turn handle (not Illustrated) may be located on an external sidewall of housing 58 to assist in rolling up the bag back into the retracted position illustrated in FIG. 21. In this embodiment, housing 58 is located in a lower part of a front door 59 (door 59 illustrating a doorknob 66). An advantage of this arrangement is that bag 61 can be placed on the ground external of the door which reduces load on the axle 62 and other parts of the apparatus. However, it is envisaged that the apparatus can be located higher on the door which means that the bag simply hangs down on the front of the door but is still secured to the axle 62 or other parts of the apparatus to prevent the bag from being stolen. It should also be appreciated that in this embodiment, the housing need not be on the rear of a door but they also be behind a wall of the dwelling, for instance, a side wall adjacent a door. Another advantage of this embodiment of the invention is that the part of the apparatus which is located behind door 59 need not be made of strong tamper proof or theft proof material which may reduce weight, cost, and manufacturing complexity of the apparatus.

FIG. 23 illustrates an embodiment of the invention wherein the bag has a large mouth area 75, a portion of which 76 can be used to secure the bag to the housing via a metal plate or strap 77. In this embodiment a panel portion (see reference numeral FIG. 23 in FIG. 3 at least) is not required.

Figure 27:
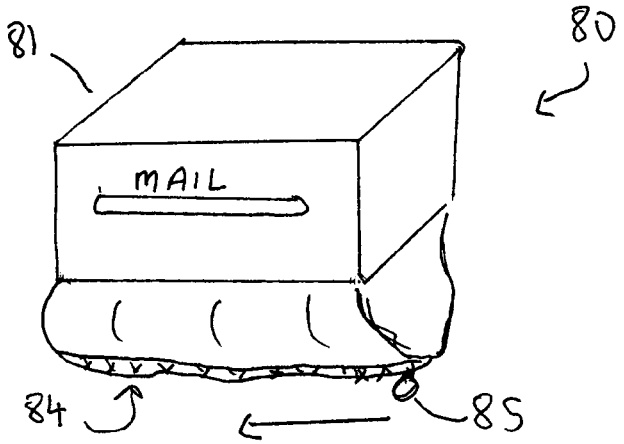
FIGS. 27 and 28 illustrate an apparatus having a pouch in which the bag is housed when not in use.
Figure 28:
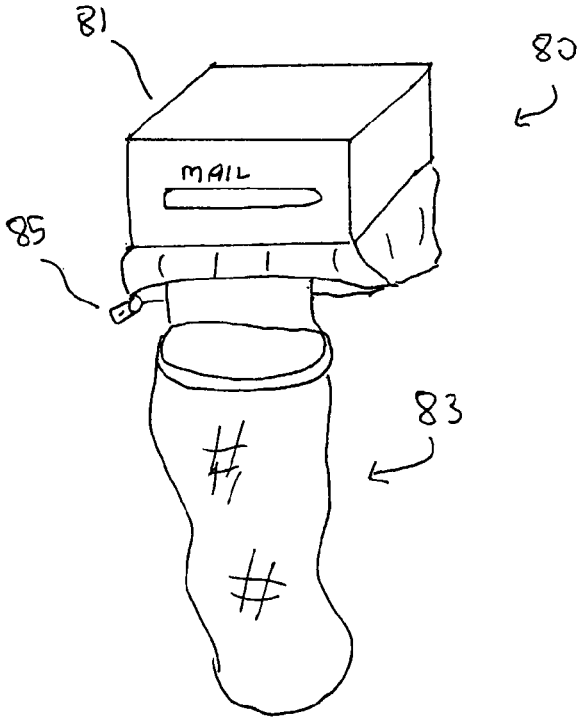

Referring now to FIGS. 27-28, there is illustrated an embodiment of the invention where the apparatus 80 comprises an upper housing 81 which can be used for conventional mail delivery. Below upper housing 81 is a pouch 82 in which a flexible bag 83 can be located. The bag can be rolled up into pouch 82, or can be crushed, folded or otherwise positioned in the pouch. Pouch 82 comprises a zip opening 84, the zip having a tang 85. The pouch can be opened by sliding tang 85 in the direction of arrow Illustrated in FIG. 27 which will enable the bag 83 to be pulled out or simply dropped down into the open position Illustrated in FIG. 28. Pouch 82 can be made of waterproof material if desired. Bag 83 can be secured to the upper housing 81 by any suitable manner and some examples are Illustrated in previous embodiments of the invention.

Figure 29:
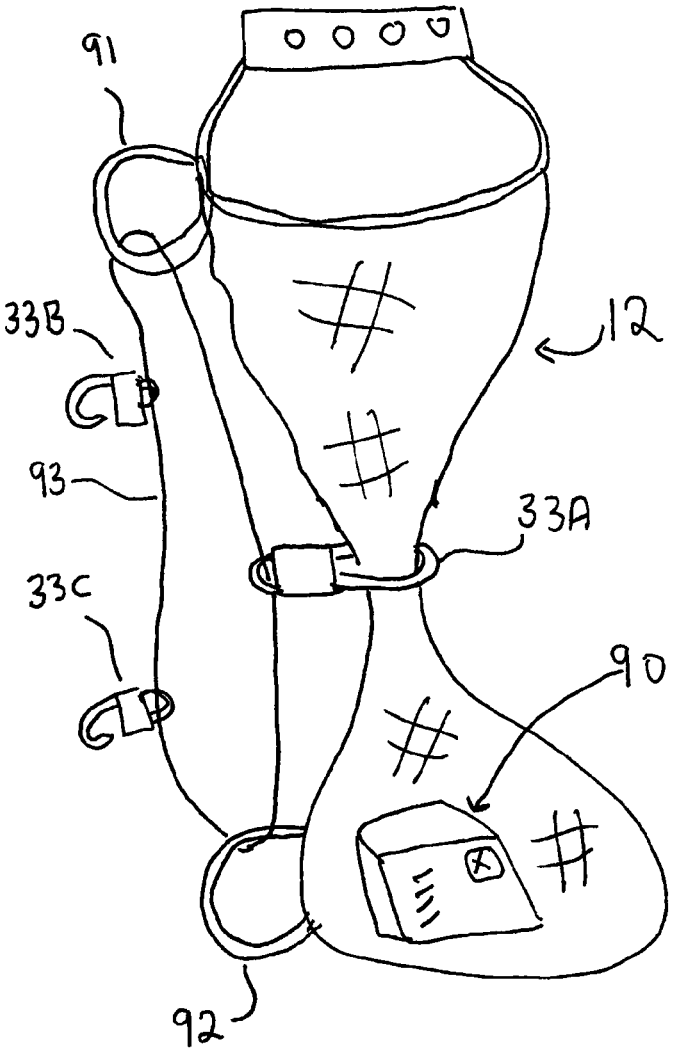
FIG. 29 illustrates a further bag locking arrangement.

FIG. 29 illustrates an apparatus having a bag 12 which can be necked and locked by a lock 33A to secure a package 90 in the bag. The bag has upper and lower cut proof loops 91, 92 attached to the bag. The loops can be made of metal rope. Loops 91, 92 are sufficiently large to enable padlocks 33A-33C to pass through the loops. The padlocks are slidingly supported by a cut proof wire/rope 93 which loops through loops 91, 92. This arrangement holds the padlocks against misplacement and allows the padlocks to lock any part of the bag. The embodiment illustrates three locks 33A-C, thereby enabling three parcels to be separately locked in the bag 12, but the number of locks can vary to suit.

Figure 30:
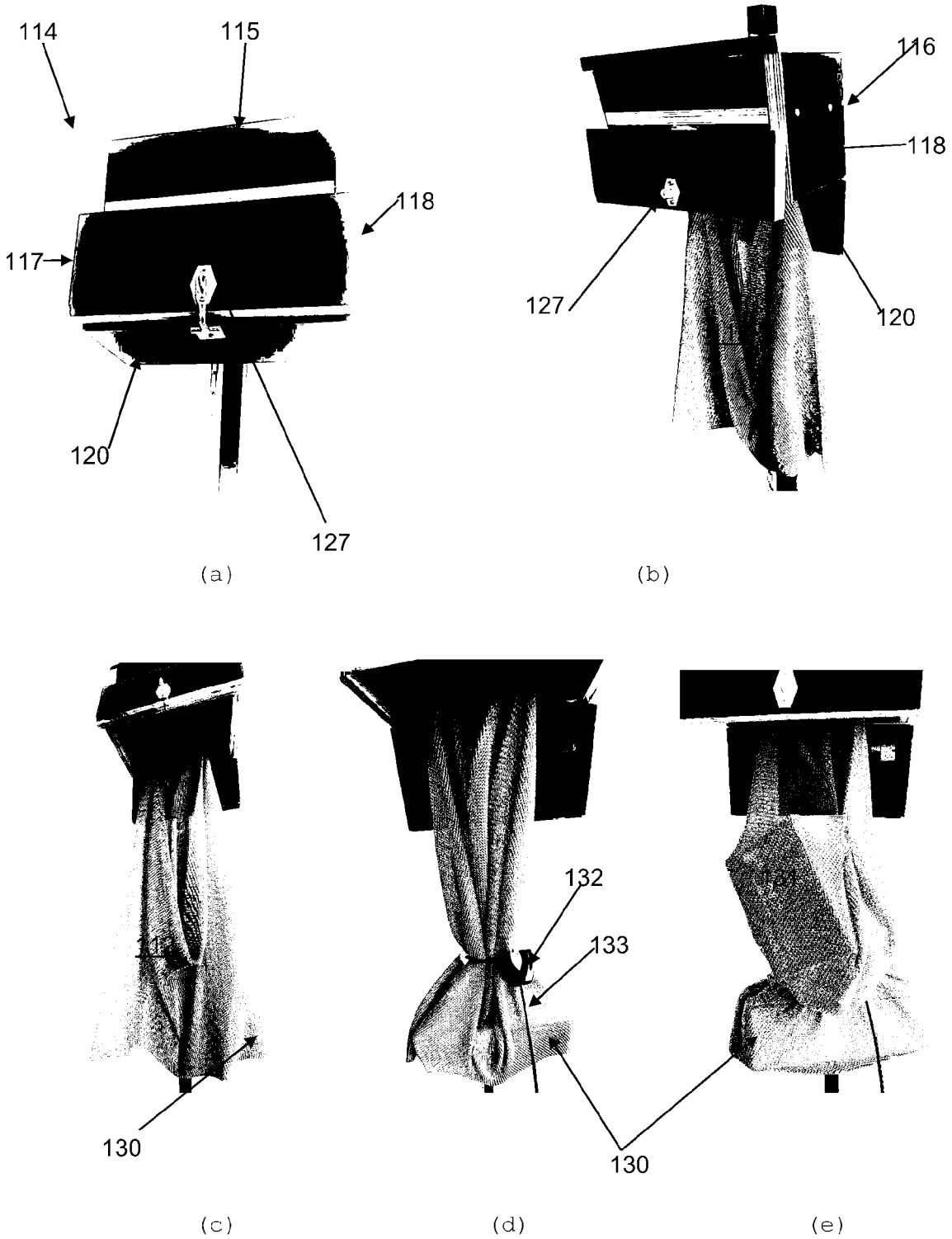
FIG. 30 illustrates another preferred embodiment of the present invention.

Referring to FIG. 30, there is illustrated an apparatus adapted to receive articles which in the preferred embodiments will be referred to as parcels/packages but it should be appreciated that the apparatus can be used to receive items other than parcels. The apparatus comprises an external housing 114 in which is located a removable flexible bag 112.

The housing 114 as illustrated in this particular embodiment is substantially rigid and rectangular when viewed in plan and side elevation. It is envisaged that the housing 114 will be manufactured from metal, rigid plastic or similar materials and will be relatively weatherproof.

Housing 114, in the particular embodiment, comprises a top wall 115, a rear wall 116, opposed sidewalls 117, 118, a front wall 19 and a bottom wall 120 which is in the form of a hinged door. The size and shape of housing can vary but an advantage of the present invention is that the apparatus can be made relatively compact while still enabling relatively large parcels to be delivered and securely stored by the apparatus. Therefore, in a particular non-limiting embodiment, it is envisaged that the apparatus will have a length of between 20-40 cm, a height of between 10-20 cm, and a width of between 10-20 cm. It should however be appreciated that no unnecessary limitation should be placed on the invention merely by describing certain dimensions of the apparatus.

Door 120 is hinged to the rear wall and this enables door 120 to move from a closed position illustrated in FIG. 30A to a drop-down open position illustrated in FIG. 30B at least. Door 120 is held in the closed position by a catch member or similar. The positioning of the door 120 on the bottom of the apparatus will cause the door to drop down into the open position illustrated in FIG. 30B, at least, by gravity.

Inside housing 114 is a flexible bag 112. Bag 112 in the particular embodiment is rolled up inside housing 14 but it is envisaged that the bag (depending on its manufacture) may be simply pushed into the housing, or folded into the housing and the like.

When door 120 is dropped down into the open position, this will cause bag 112 to fall out of the bottom of the housing and drop into the open use position illustrated in FIG. 30B. That is, no further manipulation of the bag is required.

Bag 112 is manufactured from secure material. Various types of materials are envisaged but in the particular embodiment, bag 112 is manufactured from steel links similar to chain mail.

Bag 112, in the particular embodiment, has a substantially circular or oval cross section, a length of between 50-100 cm and a diameter or cross-section of between 20-50 cm. Of course, no unnecessary limitation should be placed on the invention merely by the exemplification of certain bag sizes.

In the particular embodiment, bag 112 is secured to the rear wall 116 by any suitable means.

Bottom door 120 can be open and closed by a clasp 127. Clasp 127 enables a padlock (not illustrated) to be used to lock bottom door 120 should there be any desirability in doing this. It should also be appreciated that various other closure mechanisms can be used to secure bottom door 120.

Bottom door 120 is not locked; thus, when a parcel is delivered the bottom door can be swung down to drop down the steel mesh bag 112. A parcel 130 is placed into the bag 112 and a "loop" lock 132 is looped about bag 112 and above the parcel area. The loop portion 133 of the lock is threaded through the lock body 132 and tightened to neck the area above the parcel and then locked. Parcel 130 cannot be removed from the bag until the lock is unlocked by the owner. The bag 112 is sufficiently large to allow a second parcel 131A (see FIG. 30E) to be placed in the bag and above lock 132. A second loop lock (not illustrated) is then be positioned about the bag and above parcel 131 to lock the second parcel in the bag. The first parcel 130 remains secure and cannot be accessed by the person delivering the second parcel.

The apparatus of at least some of the above embodiments can be fitted or retrofitted to an existing mailbox. In one example, the mailbox has a front door to access mail. This door is removed and replaced with a specially designed door including a, usually lockable, door with a mail slot to receive mail and a second door which is not locked and behind which is located the bag.

It is envisaged that a larger version of the apparatus can be fixed to one side of an array of mailboxes—as might be found in apartment complexes- and which has a large bag to enable many parcels to be locked in the bag.

The apparatus as described in at least some of the above embodiments may comprise more than one bag. Thus, two or more bags may be compacted into the housing. Alternatively, the apparatus may comprise two or more compartments each containing a bag.

Figure 31:
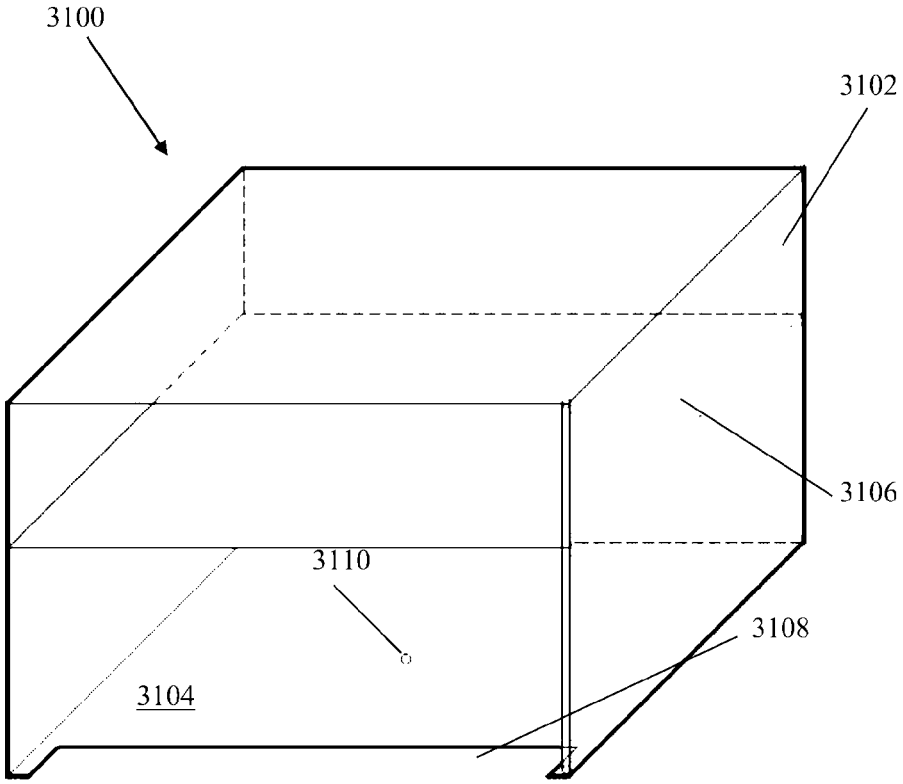
FIG. 31 illustrates the housing portion of an apparatus in accordance with a further preferred embodiment of the present invention, the housing portion having a base including a slot.

Referring to FIGS. 31-37, there is illustrated an apparatus adapted to received articles similar to the apparatus shown in FIG. 30. In this preferred embodiment, the apparatus is in the form of a letterbox or mailbox 3100. As best shown in FIG. 31, letterbox 3100 includes housing 3102 defining a volume, and including an internal shelf 3106 for dividing the volume of the housing such that an upper volume is defined for receiving letters and a lower volume is defined for locating one or more containers, in the form of one or more bags or sacks 3400. Housing 3102 further includes a base 3104 including an elongate slot 3108 for passing a portion of a container therethrough. Base 3104 also includes an aperture 3110 for allowing water, or any other liquid, to drain out of housing 3102.

Figure 32:
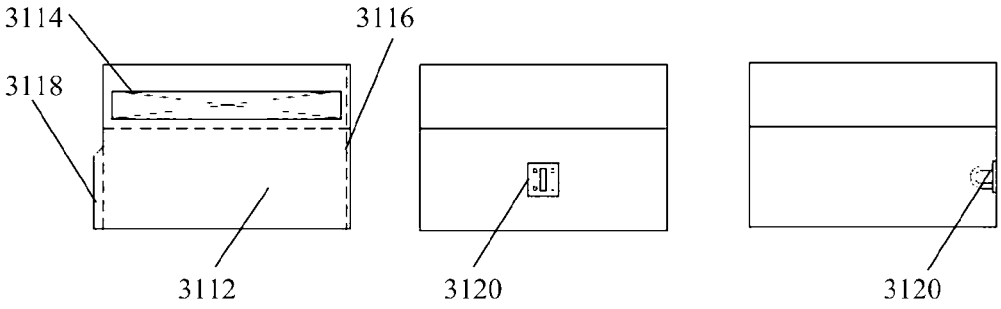
FIG. 32 illustrates front, internal and an internal side views of the apparatus in accordance with the embodiment shown in FIG. 31.
Figure 33:
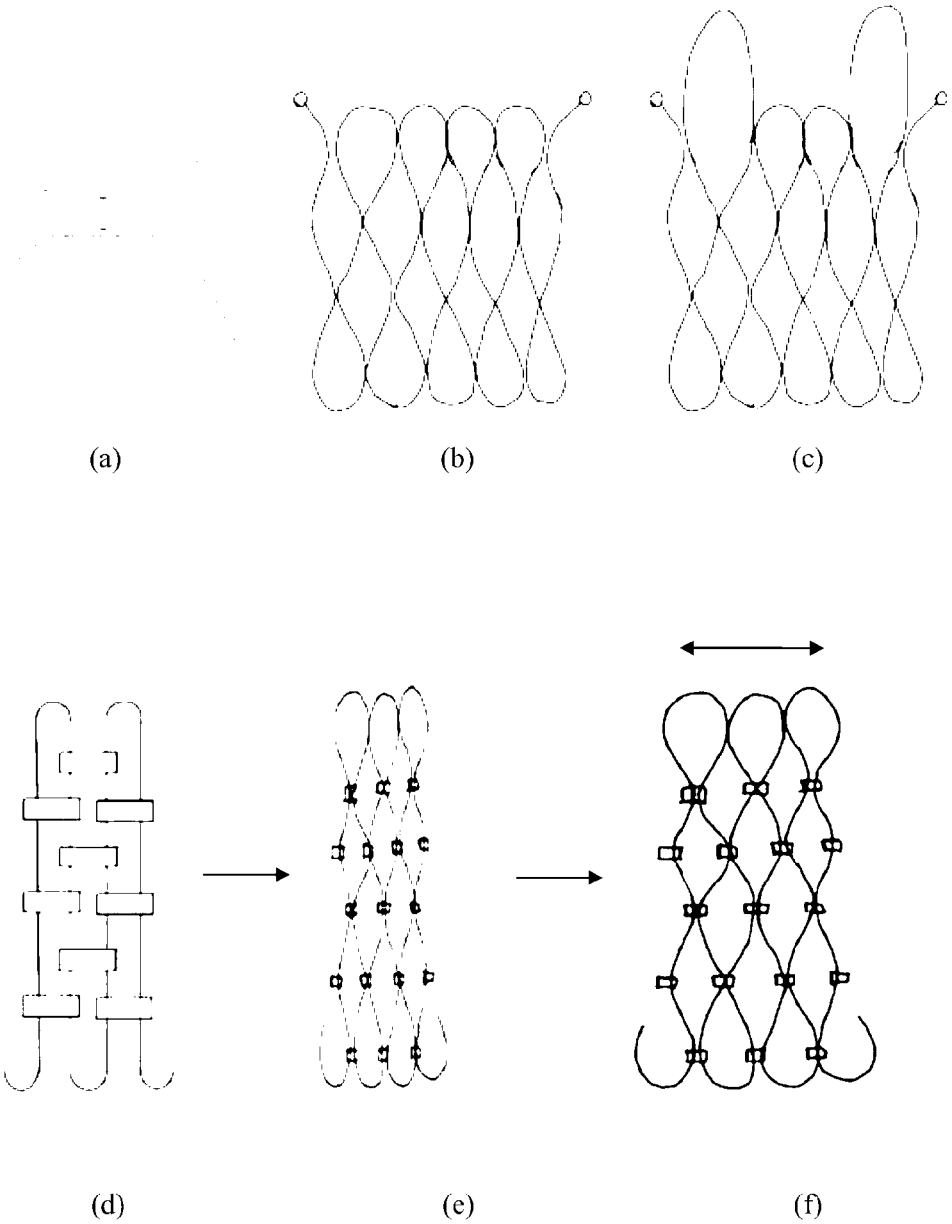
FIG. 33 illustrates types of continuous wire formations from which the container, in the form of a bag or sack, may be made, in accordance with the preferred embodiments of the present invention.
Figure 34:
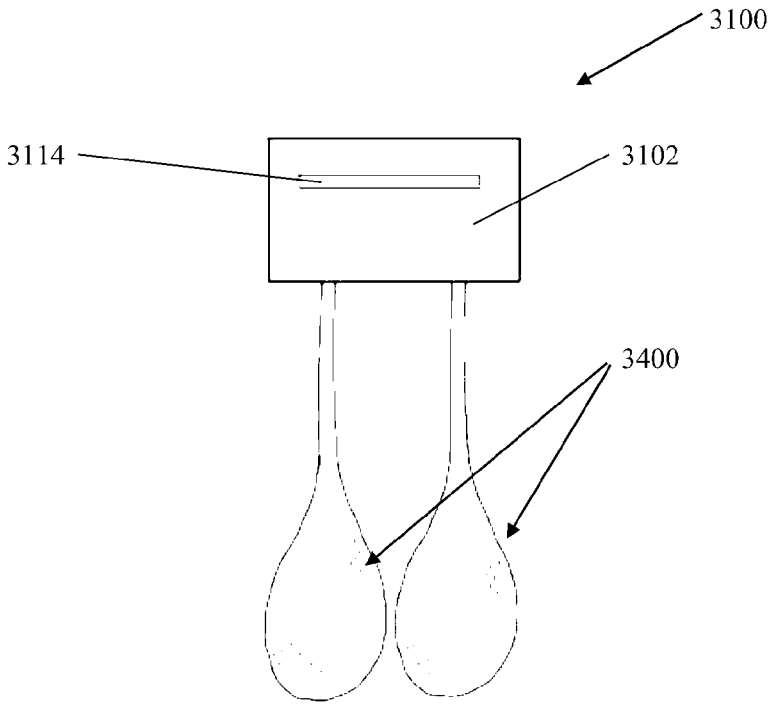
FIG. 34 illustrates the apparatus, in the form of a letterbox, in accordance with the preferred embodiment of the present invention as shown in FIG. 32, the letter box being in an in-use configuration.

As best shown in FIG. 32, letterbox 3100 further includes a hinged panel, in the form of a front panel 3112, for accessing the internal volumes of housing 3102. Panel 3112 includes a slot or opening 3114 for receiving articles, in the form of letters. Slot 3114 is positioned such that passage through the slot leads to the upper volume of housing 3102.

In the preferred embodiment shown, the hinged panel is hinged about a side edge 3116 of panel 3112. In the preferred embodiment shown, panel 3112 includes a securing mechanism, in the form of a lock, for securing the panel to housing 3102. The securing mechanism has a locked and unlocked condition. Panel 3108 further includes a tab, in the form of a side tab 3118 for aiding in opening panel 3108 when the panel is in an unlocked condition.

Figure 35:
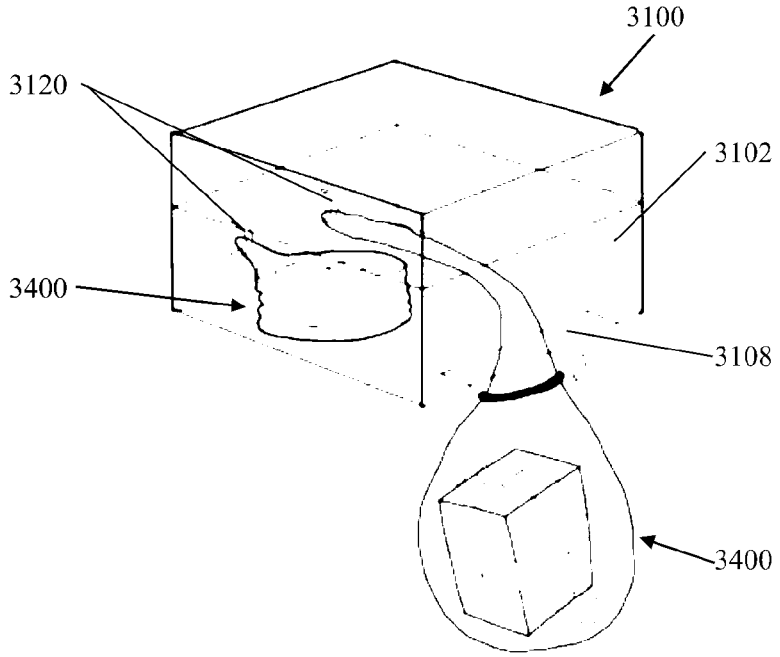
FIG. 35 illustrates the apparatus, in the form of a letterbox, in accordance with the preferred embodiment of the present invention as shown in FIG. 32, the letter box being in an in-use configuration, wherein one container, in the form of a sack holds a parcel, and the other container, also in the form of a sack, is stored inside a housing.
Figure 36:
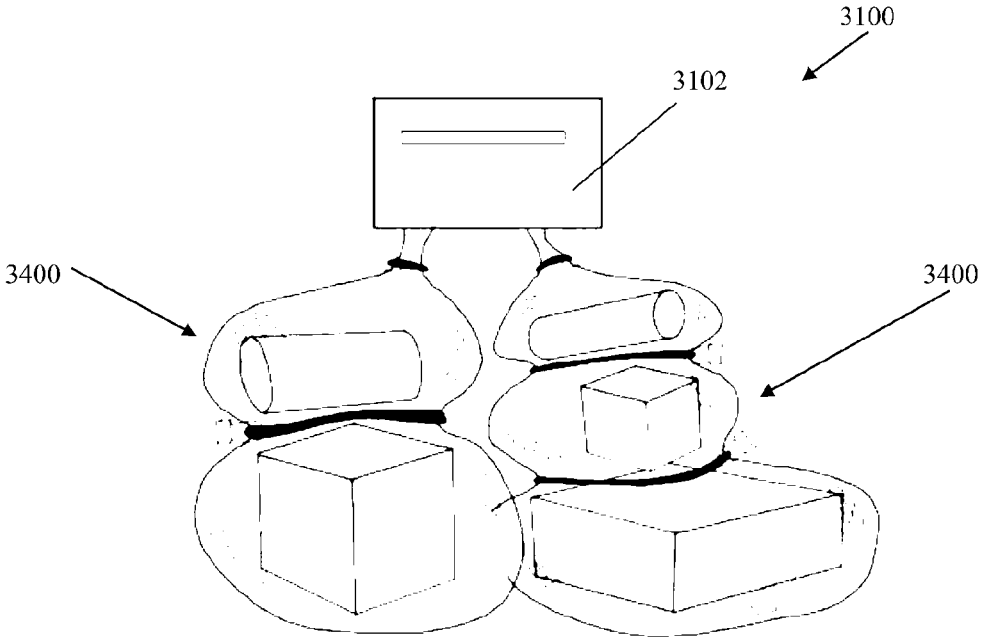
FIG. 36 illustrates the apparatus, in the form of a letterbox, in accordance with the preferred embodiment of the present invention as shown in FIG. 32, the letter box being in an in-use configuration, wherein a pair of containers, in the form of a pair of sacks are containing multiple parcels.
Figure 37:
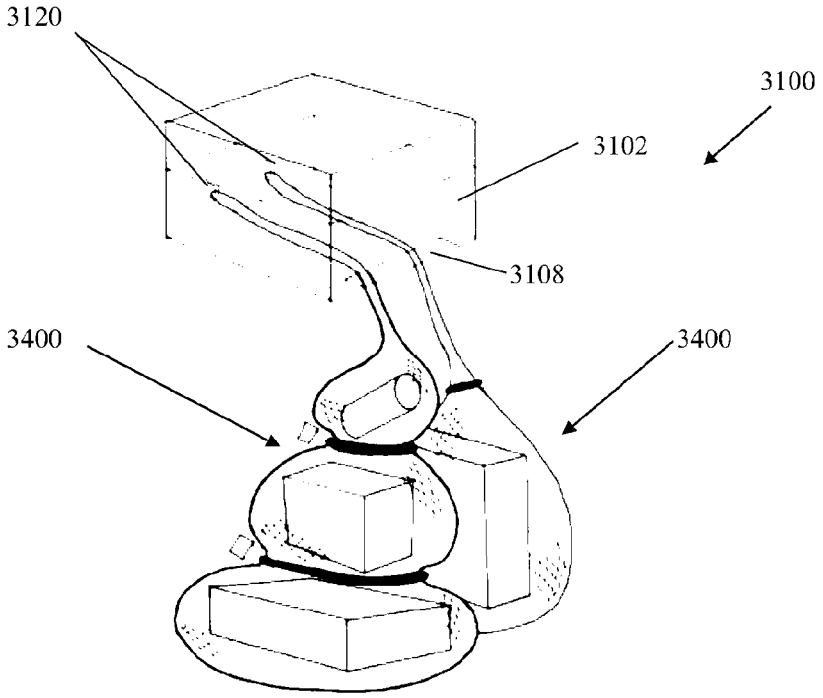
FIG. 37 illustrates the apparatus, in the form of a letterbox, in accordance with the preferred embodiment of the present invention as shown in FIG. 32, the letter box being in an in-use configuration, wherein a pair of containers, in the form of a pair of sacks are containing multiple parcels.

Housing 3102 further includes hooks or loops, in the form of a D-brackets 3120, each for securing a container, in the form of bag or sack 3400, thereto. Each D-bracket 3120 is located inside the lower volume of housing 3102 (best shown in FIG. 32). In the preferred embodiment shown, in FIGS. 31-37, each bag or sack 3400 is attached to one of the D-brackets 3120 such that when letterbox 3100 is in an in-use configuration, at least a portion of one of bags or sacks 3400 is able to be passed through slot 3108 such that an article, in the form of a parcel, is received and secured within one or more compartments formed in the bag or sack (as best shown in FIGS. 35 to 37). When letterbox 3100 is in a non-use configuration, one or more containers 3400 are locatable inside the lower volume of housing 3102 (as shown in FIG. 35).

The apparatus as described in the above embodiments may include further features. As an example, the apparatus may include some form of signalling device to send a signal to the owner when a parcel is delivered. The signalling device may be associated with the door should the apparatus contain a door such that when the door is opened a signal is sent to the owner. Alternatively, a button may be provided for the delivery person to activate to send a signal to the home owner.

The apparatus allows for the delivery of packages in a secure manner without the occupants being at home. The apparatus can be made quite small yet still able to securely accommodate large parcels. This is achieved by the bag being able to adopt a smaller stored dimension and a large expanded use dimension. Multiple parcels can be delivered and stored. The bag is secured against theft and it is considered suitable that the bag is secured to some part of the apparatus. However, there may be circumstances where there is an advantage in securing the bag to a support which is different to the apparatus and the remainder of the apparatus is secured to the support or to a different support. It is however considered most suitable that the apparatus is "self-contained" and has the bag secured to the apparatus which should make installation of the apparatus simpler.

It is envisaged that an electronic option may be provided where authorisation to leave the package is made remotely, for instance, by using a camera. It is envisaged that some form of auto locking capability may also be used. It is envisaged that a QR code may be provided to approve packages to be left. An advantage of this embodiment is that no power need be required. It is envisaged that a unique ID may be provided to allow packages to be left.

A further advantage of the present invention may be that the apparatus can be used to return packages or to send packages as well as receiving packages. A homeowner can securely leave a return package or a send package in the bag for the delivery person to pick up. With this arrangement, the homeowner need not be present.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

Throughout the body of the specification, and the claims, the terms 'mailbox' and 'letterbox' are used interchangeably and define any receptacle for receiving a posted item or article, such as a letter, satchel or parcel.

The invention claimed is:

1. A mailbox for receiving and holding at least one article, comprising:

a container for receiving the at least one article, the container positionable between a stored position and an in-use position defining a volume larger than the volume of the container when in the stored position, and being secured against unauthorised removal;

a housing for at least partially housing the container and from which the container can be at least partially removed; and, at least one securing means for securing the at least one article in the container;

wherein the container and the at least one securing means are configurable to define multiple compartments when the container is in the in-use position, each compartment adapted to receive an article of the at least one articles and adapted to be secured against unauthorised removal of the article.

2. The mailbox as claimed in claim 1, wherein the container is rollable, foldable, crushable, compressible or otherwise deformable into a smaller volume for assuming the stored position.

3. The mailbox as claimed in claim 1, wherein the multiple compartments of the container defines at least two compartments which are separately securable.

4. The mailbox as claimed in claim 3, wherein the at least two compartments are made from different materials.

5. The mailbox as claimed in claim 1, wherein the container is fabricated from a metal mesh, chainmail, slash proof fabric, strong canvas material, and/or Kevlar.

6. The mailbox as claimed in claim 1, wherein the container is made from an opaque material.

7. The mailbox as claimed in claim 1, wherein the container is made from water repellent, water resistant, or waterproof material.

8. The mailbox as claimed in claim 1, wherein the housing includes a housing compartment for at least partially housing the container.

9. The mailbox as claimed in claim 8, wherein the housing compartment defines an opening from which the container can be removed, wherein the opening is located in a base portion of the housing.

10. The mailbox as claimed in claim 1, wherein the container is securely attached to the housing or an intermediate member to prevent the container from being removed.

11. The mailbox as claimed in claim 10, wherein the housing or the intermediate member is securely fastened to a support to prevent the container from being removed.

12. The mailbox as claimed in claim 1, wherein the securing means includes a chain lock, or a drawstring and a lock.

13. The mailbox as claimed in claim 1, wherein the securing means includes a padlock including a shank or shackle, and the container further includes a series of small openings, which can be drawn together, the shank or shackle being passed through two or more of the openings to close the container sufficiently to prevent the article from being removed.

14. The mailbox as claimed in claim 1, wherein the at least one securing means includes multiple securing means.

15. The mailbox as claimed in claim 1, wherein the container is in the form of a bag or sack.

16. The mailbox as claimed in claim 1, wherein the housing includes a base, and the base includes an opening through which at least a portion of the container extends when in the in-use position.

17. The mailbox as claimed in claim 16, wherein the opening in the base is in the form of an elongate slot and/or wherein the housing includes an opening in the base for allowing liquids to drain out of the housing.

18. The mailbox as claimed in claim 1, wherein the housing defines an internal volume and comprises an internal shelf for dividing the internal volume into an upper volume for housing letters and a lower volume for housing the container, wherein the housing includes a door for accessing the upper volume and the lower volume, and wherein the door forms a front panel of the housing and wherein the door includes a letterbox slot for receiving letters into the upper volume of the internal volume.

19. A mailbox for receiving and holding at least one article, comprising:

a container for receiving the at least one article, the container positionable between a stored position and an in-use position defining a volume larger than the volume of the container when in the stored position, and being secured against unauthorised removal;

a housing for at least partially housing the container and from which the container can be at least partially removed, the housing including a base having a slot for passing at least a portion of the container therethrough; and, at least one securing means for securing the at least one article in the container;

wherein the container and the at least one securing means are configurable to define multiple compartments when the container is in the in-use position, each compartment adapted to receive an article of the at least one articles and adapted to be secured against unauthorised removal of the article.

* * * * *